United States Patent [19]

Stanley

[11] 4,065,864

[45] Jan. 3, 1978

[54] STAMP STOCK SHEET

[75] Inventor: William Joseph Stanley, Brantford, Canada

[73] Assignee: 234966 Wholesale Ltd., Paris, Canada

[21] Appl. No.: 729,026

[22] Filed: Oct. 4, 1976

[51] Int. Cl.[2] ..... G09F 7/00

[52] U.S. Cl. ..... 40/405; 40/159

[58] Field of Search ..... 40/104.19, 104.18, 159, 40/158 R

[56] References Cited

U.S. PATENT DOCUMENTS

| | | | |
|---|---|---|---|
| 1,320,683 | 11/1919 | Goodhue | 40/104.19 |
| 2,421,503 | 6/1947 | Hermon | 40/104.19 |
| 3,822,495 | 7/1974 | Ohfuji | 40/104.18 |

FOREIGN PATENT DOCUMENTS

| | | | |
|---|---|---|---|
| 707,790 | 6/1966 | Italy | 40/104.18 |

*Primary Examiner*—Russell R. Kinsey
*Assistant Examiner*—Wenceslao J. Contreras
*Attorney, Agent, or Firm*—Hirons & Rogers

[57] ABSTRACT

A stock sheet for postage stamps and the like that can be used alone, or in multiples to form an album, consists of two sheets of inert, transparent plastic material heat sealed to one another and folded about an intervening record sheet of card on which information can be written. The record sheet can be viewed through the transparent sheets which are heat sealed to one another along their edges in two respective sets. The two sheets of each set are also joined to one another by heat-sealed lines to form a plurality of enclosures for receiving the stamps and the like. Entrance to the enclosures is by cuts in the outer sheet of each pair spaced from the immediately-adjacent joint line to provide a space for the reception and retention of the edge of a stamp therein. The two sets are fastened securely to each other and to the record sheet by heat-sealing through one or more apertures, such as elongated slots, in one edge of the record sheet.

6 Claims, 3 Drawing Figures

STAMP STOCK SHEET

FIELD OF THE INVENTION

The present invention is concerned with improvements in or relating to stock sheets for the reception of thin flat articles, such as postage stamps, which sheets can be employed individually or assembled into the form of an album.

REVIEW OF THE PRIOR ART

The provision of a stock sheet, suitable for use in storing potentially valuable thin flat items such as postage stamps, is unexpectedly difficult. A common prior art construction consists for example of a sheet of clear acetate plastic glued to a card backing so as to provide pockets into which the stamps, etc. are slipped. It is then found that dimensional changes with temperature, humidity, etc. cause the glue to fail, the stamp then being able to contact the exposed glue and being damaged thereby. As card stock ages it gives off small quantities of gases that change the stamps colouring, decreasing its value. The stamps must be fully retained at all times and yet they must be easily removed and replaced for inspection of the back without danger of mechanical damage. Some provision must be made to write notes for each stamp without the danger of ink contacting the stamp and destroying its value.

DEFINITION OF THE INVENTION

It is an object of the present invention to provide a new stock sheet fo stamp albums and the like, especially such a sheet that can be readily assembled into a multipage album.

In accordance with the present invention there is provided a stock sheet for stamp albums and the like comprising:

a. a sheet of opaque material for written records having two opposite record-receiving surfaces and having at least one opening therein adjacent to one edge thereof;

b. two sets each of a pair of parallel juxtaposed transparent sheets of flexible material heat-seal-joined to one another along joint lines at their edges and also along other joint lines to form a plurality of corresponding enclosures bounded on all sides by joint lines, the two sets having the record sheet sandwiched between them, so that each said record receiving surface is visible through the respective set;

c. the outer one of each said pair of sheets of a set having cut lines therein extending therethrough to constitute entries for stamps and the like into the respective enclosure to be retained therein;

d. the said two sets being fastened to one another and to the record sheet by being heat sealed to one another through the said aperture in the record sheet, whereby the sets are hingedly connected to the record sheet to permit movement of the sets away from the record sheet and thereby viewing of the stamps and the like through both the outer sheet and the inner sheet.

DESCRIPTION OF THE DRAWINGS

A stock sheet which is a particular preferred embodiment of the invention will now be described by way of example, with reference to the accompanying diagrammatic drawing wherein.

DESCRIPTION OF THE PREFERRED EMBODIMENTS

Figure 1:
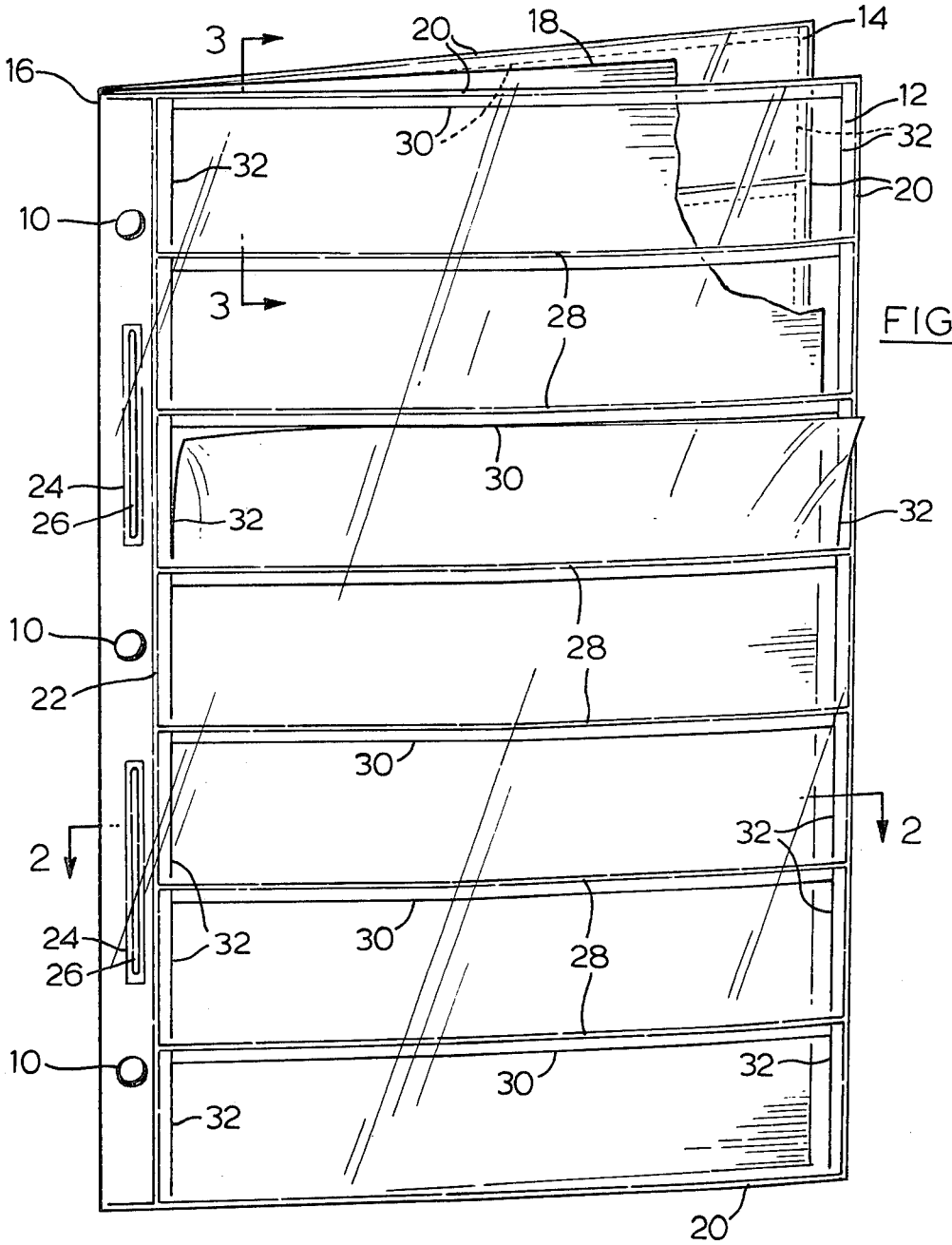
FIG. 1 is a general perspective view of the stock sheet, part of the record sheet being shown broken away from the second set to be seen more clearly.
Figure 2:
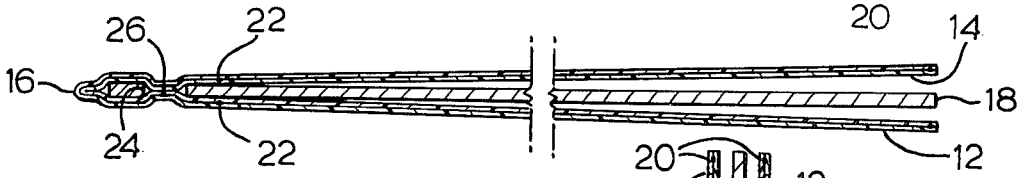
FIGS. 2 and 3 are cross-sections taken respectively on the lines 2—2 and 2-3 of FIG. 1.
Figure 3:
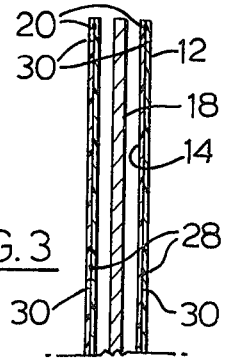

The stock sheet particularly illustrated herein is intended for use as a loose leaf sheet in a three-ring binder, and is therefor provided with three holes 10 for the reception of the binding rings. However, any number of such sheets can be bound into an album, or they can be used singly, perhaps in an appropriate external wrapper.

The stock sheet is formed from two parallel juxtaposed thin sheets 12 and 14 of an inert flexible plastic transparent material, such as acrylic resin, the sheets being folded together along a fold line 16 about a central doublesided record sheet 18 of white card suitable for writing on in pencil or ink. The two sheets are heat-sealed to each other at edge joint lines 20 along all their edges to form two sets, one on each side of the record sheet. The sheets are also sealed to one another along a line 22 parallel to the fold line 16 and spaced therefrom a sufficient distance to accommodate the punch holes 10 in the spine portion thus formed.

The corresponding interposed spoine portion of the record sheet is provided with two longitudinal slots 24 therein and the two sets are heat-sealed together through these slots at 26, so that the sets are permanently retained in the folded condition with the record sheet permanently fastened between them.

Each set of the two portions of the sheets 12 and 14 is provided with a plurality of parallel spaced joint lines 28, in this embodiment parallel to the shorter sides of the stock sheet, dividing the pair to form a corresponding plurality of enclosures for receiving the stamps, match covers, cards and the like items to be stored therein, each such enclosure being of elongated rectangular shape bounded on all four sides by heat sealed joint lines. The sheet portion 12 of each such enclosure is provided with three through cuts 30 and 32, the cut 30 being parallel to the joint line 28 and extending between the two cuts 32, while the cuts 32 are parallel to an edge joint line 20 and to the spine joint line 22 and extend fully between two immediately adjacent joint lines 28. These cuts constitute entries to the respective enclosure for the stamps, etc., each cut being spaced from its immediately adjacent joint line to provide a corresponding portion of the enclosure into which an edge of the stamp, etc. can enter, as will be explained below.

Such a stock sheet has a number of important advantages over the known prior art sheets. For example, a stamp, etc. in its enclosure can be viewed on both sides, and/or viewed against a light, and it is no longer necessary to remove it for full inspection.

The two sheets forming the enclosure are of the same inert plastic material, that are similarly affected by heat and humidity, so that there is no tendency for them to separate in time. No glue is used that could possibly damage a stamp, even if the heat-sealed joints failed at some time.

The card record sheet is separated from the stamps, etc. by a sheet of inert plastic, so that any decomposition products thereof will not affect the items in the enclosures, and yet notes and descriptions of the enclosure contents can be added without difficulty and without disturbing its contents. Specifically, information such as the stamp values can be placed thereon and will not be seen until the item is lifted.

The spacing of the die cuts from the joints leaves a small space between each cut and joint so that, for example, if the sheet falls on its side, the contents will be caught in this space and will not fall out of the enclosure. Normally, the larger bottom flap alone is bent down for insertion of an item, but the top flap also may be bent if necessary for the insertion of taller items.

I claim:

1. A stock sheet for stamp albums and the like comprising:

a. a sheet of opaque material for written records having two opposite record-receiving surfaces and having at least one opening therein adjacent to one edge thereof;

b. two sets each of a pair of parallel juxtaposed transparent sheets of flexible material heat-seal-joined to one another along joint lines at their edges and also along other joint lines to form a plurality of corresponding enclosures bounded on all sides by joint lines, the two sets having the record sheet sandwiched between them, so that each said record receiving surface is visible through the respective set;

c. the outer one of each said pair of sheets of a set having cut lines therein extending therethrough to constitute entries for stamps and the like into the respective enclosure to be retained therein;

d. the said two sets being fastened to one another and to the record sheet by being heat sealed to one another through the said aperture in the record sheet, whereby the sets are hingedly connected to the record sheet to permit movement of the sets away from the record sheet and thereby viewing of the stamps and the like through both the outer sheet and the inner sheet.

2. A stock sheet as claimed in claim 1, wherein the said two sets are formed from two single sheets heat sealed to one another at their edges and folded about the record sheet.

3. A stock sheet as claimed in claim 1, wherein the two sets are fastened to one another and to the record sheet by being heat sealed to one another through at least one slot in the record sheet.

4. A stock sheet as claimed in claim 1, wherein the two sets are fastened to one another and to the record sheet by being heat sealed to one another through two spaced elongated slots adjacent the said one edge of the record sheet.

5. A stock sheet as claimed in claim 2, wherein the two sets are fastened to one another and to the record sheet by being heat sealed to one another through two spaced elongated slots adjacent the said one edge of the record sheet.

6. A stock sheet as claimed in claim 1 wherein the part of each enclosure between a cut line and the immediately adjacent joint line is of sufficient width to constitute a shallow pocket adapted to receive and retain therein an edge of a stamp or the like in the respective enclosure.

* * * * *